US005798737A

United States Patent [19]

Kanaba et al.

[11] Patent Number: 5,798,737

[45] Date of Patent: Aug. 25, 1998

[54] CHIP ANTENNA

[75] Inventors: Seiji Kanaba, Otsu; Kenji Asakura, Shiga; Tsuyoshi Suesada, Omihachiman; Teruhisa Tsuru, Kameoka; Harufumi Mandai, Takatsuki, all of Japan

[73] Assignee: Murata Mfg. Co., Ltd., Kyoto, Japan

[21] Appl. No.: 971,836

[22] Filed: Nov. 17, 1997

Related U.S. Application Data

[63] Continuation of Ser. No. 708,400, Sep. 4, 1996, abandoned.

[30] Foreign Application Priority Data

Sep. 5, 1995 [JP] Japan ..... 7-228128

[51] Int. Cl.[6] ..... H01Q 1/24; H01Q 1/36

[52] U.S. Cl. ..... 343/895; 343/702; 343/873

[58] Field of Search ..... 343/895, 702, 343/787, 788, 718, 873; H01Q 1/24, 1/36

[56] References Cited

U.S. PATENT DOCUMENTS

| | | | |
|---|---|---|---|
| 2,472,106 | 6/1949 | Hansen | 343/727 |
| 3,949,407 | 4/1976 | Jagdmann et al. | 343/895 |
| 5,136,303 | 8/1992 | Cho et al. | 343/718 |
| 5,250,923 | 10/1993 | Ushiro et al. | 336/83 |
| 5,341,148 | 8/1994 | Walter et al. | 343/895 |
| 5,412,392 | 5/1995 | Tsunekawa | 343/702 |
| 5,541,610 | 7/1996 | Imanishi et al. | 343/895 |

FOREIGN PATENT DOCUMENTS

| | | |
|---|---|---|
| 0621653 | 10/1994 | European Pat. Off. . |
| 0687030 | 12/1995 | European Pat. Off. . |

*Primary Examiner*—Hoanganh T. Le

*Attorney, Agent, or Firm*—Ostrolenk, Faber, Gerb & Soffen, LLP

[57] ABSTRACT

A chip antenna having a substrate comprising either of a dielectric material or a magnetic material, at least one conductor formed on at least one side of a surface of the substrate or inside the substrate, and at least one feeding terminal provided on the surface of the substrate for applying a voltage to the conductor, a part of the conductor connecting with the feeding terminal. The end section of the conductor or a portion of the conductor other than an end section of the conductor may be connected with the feeding terminal.

19 Claims, 7 Drawing Sheets

CHIP ANTENNA

This is a continuation of application Ser. No. 08/708,400 filed on Sep. 4, 1996, now abandoned.

BACKGROUND OF THE INVENTION

1. Field of the Invention

The present invention relates to chip antennas. In particular, the present invention relates to a chip antenna used for mobile communication and local area networks (LAN).

2. Description of the Related Art

FIG. 9 shows a prior art monopole antenna 70. The monopole antenna 70 has a conductor 71 perpendicular to an earth plate (not shown in the figure) and a structure of which one end 72 of the conductor 71 is a feeding section and the other end 73 is a free end in the air (dielectric constant $\epsilon=1$ and relative permeability $\mu=1$).

FIG. 10 shows a double-resonance antenna or array antenna comprising two monopole antennas 80, 90, as an example of a multiple-resonance antenna, wherein the multiple resonance antenna is defined as an antenna having a plurality of main resonance frequencies. These monopole antennas 80, 90 also have conductors 81, 91 perpendicular to an earth plate (not shown in the figure). One end 82, 92 of each conductor 81, 82 is a feeding section and the other end 83, 93 is a free end, like the monopole antenna 70. In such an antenna, a wide space between the monopole antennas 80 and 90 must be left in consideration of the interaction between the monopole antennas 80 and 90.

In linear antennas such as the prior art monopole antenna 70, because the conductor of the antenna is present in air, the size of the antenna conductor is required to be larger. For example, when the wavelength in a vacuum is $\lambda_0$ for the monopole antenna 70, the length of the conductor 72 must be $\lambda_0/4$. The space between the monopole antennas 80 and 90 in the multi-resonance antenna or array antenna comprising a plurality of monopole antennas also must be around $\lambda_0/4$. Thus, for reasons of shape and size, such an antenna cannot be readily used for mobile communication or the like which requires a compact antenna.

SUMMARY OF THE INVENTION

It is an object of the present invention to provide a compact chip antenna which can be used for mobile communication or the like.

In accordance with the present invention, a chip antenna comprises a substrate comprising at least one of a dielectric material and a magnetic material, at least one conductor formed at least one of on at least one side of a surface of the substrate and inside the substrate, and at least one feeding terminal provided on the surface of the substrate for applying a voltage to the conductor, a part of the conductor connecting with the feeding terminal.

An end section of the conductor may connect with the feeding terminal.

A portion other than the end section of the conductor may connect with the feeding terminal.

Because the chip antenna in accordance with the present invention comprises a substrate formed either of a dielectric material or a magnetic material, the wavelength is shortened due to the wavelength shortening effect of the substrate. Further, the space between a plurality of conductors can be narrowed.

DESCRIPTION OF THE PREFERRED EMBODIMENTS

Embodiments in accordance with the present invention will now be explained with reference to the drawings. In the embodiments, the same number in the figures refers to the same section or part.

Figure 1:
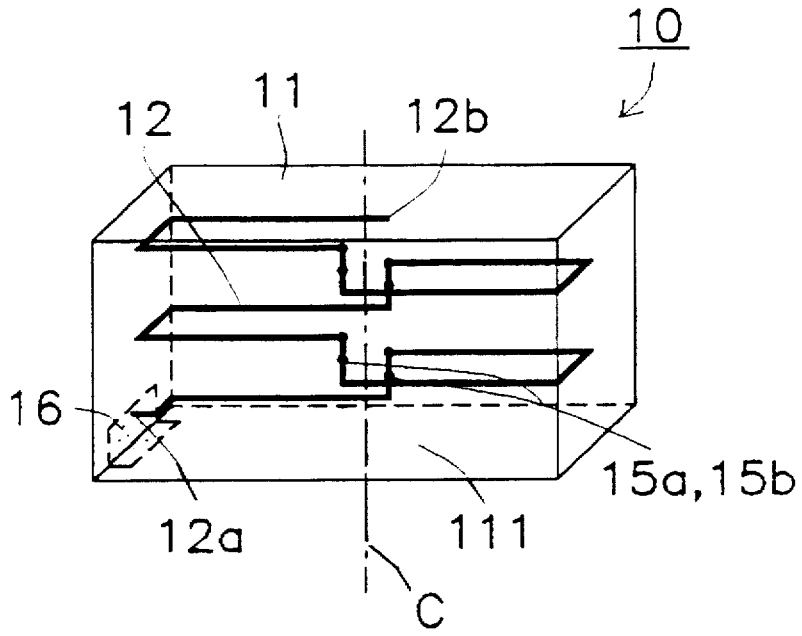
FIG. 1 is an isometric view illustrating a first embodiment of a chip antenna in accordance with the present invention.
Figure 2:
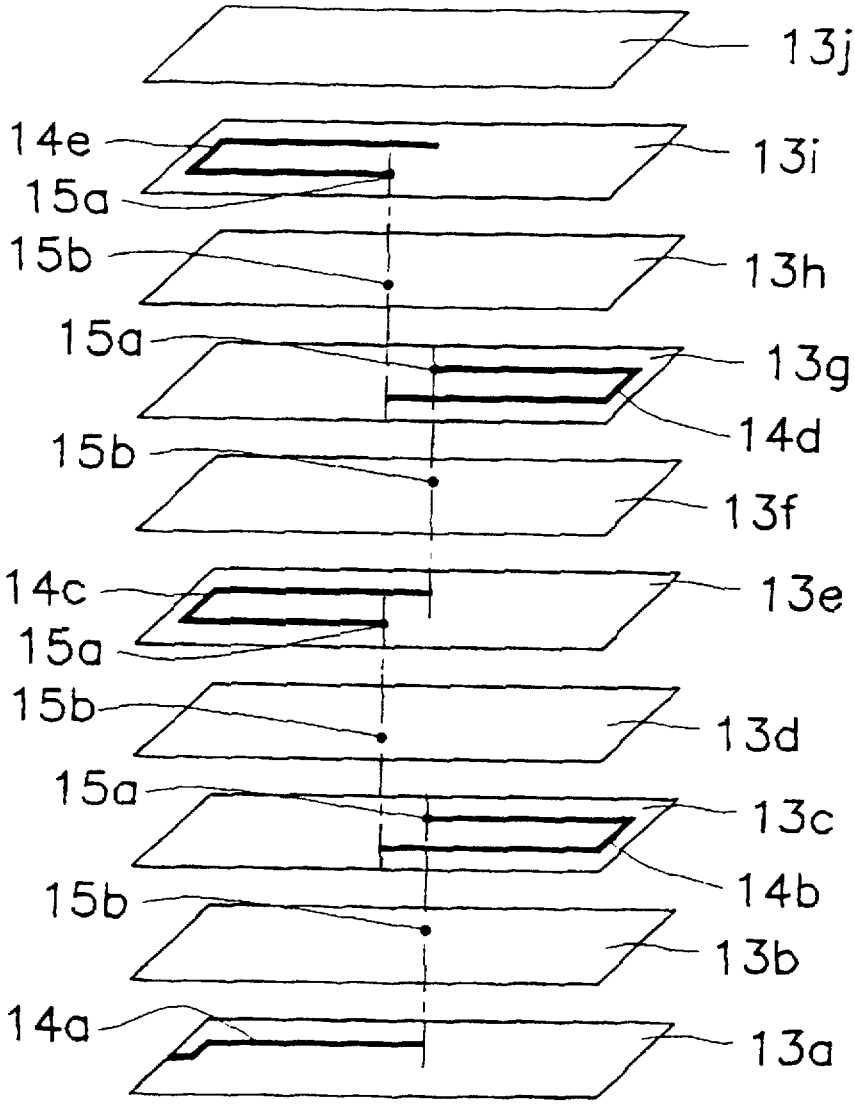
FIG. 2 is a decomposed isometric view of the chip antenna in FIG. 1.

FIG. 1 is an isometric view illustrating a first embodiment of a chip antenna in accordance with the present invention and FIG. 2 is a decomposed isometric view of FIG. 1. The chip antenna 10 comprises a conductor 12 spirally arranged in a rectangular parallelopiped substrate 11 having a mounting surface 111 along a spiral axis C perpendicular to the mounting surface 111, in other words, along the vertical direction of the substrate 11. The substrate 11 is formed by laminating rectangular dielectric sheets **13*a* through 13*j* each comprising a dielectric material (dielectric constant: approx. 60) preferably mainly containing titanium oxide, barium oxide and neodymium oxide. The dielectric sheets 13*a*, 13*c*, 13*e*, 13*g* and 13*i* are provided on their surfaces with angular conductive patterns 14*a* through 14*e* (conductive patterns 14*b* to 14*c* being substantially U-shaped), respectively, which are formed by printing, evaporation, adhesion, or plating etc., and preferably comprise a silver=palladium (Ag-Pd) alloy. One end of each of the conductive patterns 14*b* through 14*e* is provided with a via hole 15*a***.

Each of the conductive sheets **13*b*, 13*d*, 13*f* and 13*h* is provided with a via hole 15*b* at the position corresponding to the via hole 15*a*, in other words, corresponding to one end of the conductive pattern 14*a* and the other ends of the conductive patterns 14*b* through 14*d*. After the dielectric sheets 13*a* through 13*j* are laminated with heat, the conductive patterns 14*a* through 14*e* connect with each other through via holes 15*a* and 15*b* to form the spiral conductor 11 having a rectangular cross-section. The thickness of each of the dielectric sheets 13*b* through 13*i*** is determined by a predetermined frequency of the antenna.

One end of the conductor 12 or the other end of the conductive pattern **14*a* is drawn out to the surface of the substrate 11 to form a feeding section 12*a* which connects with a feeding terminal 16 on the surface of the substrate 11 for applying a voltage to the conductor 12. The other end of the conductor 12 or the other end of the conductive pattern 14e forms a free end 12b in the substrate 11**.

In the first embodiment as set forth above, because the conductor is provided inside the substrate comprising a dielectric material, the line length of the conductor is shortened due to the wavelength shortening effect of the substrate, resulting in the achievement of miniaturization of the chip antenna.

Figure 3:
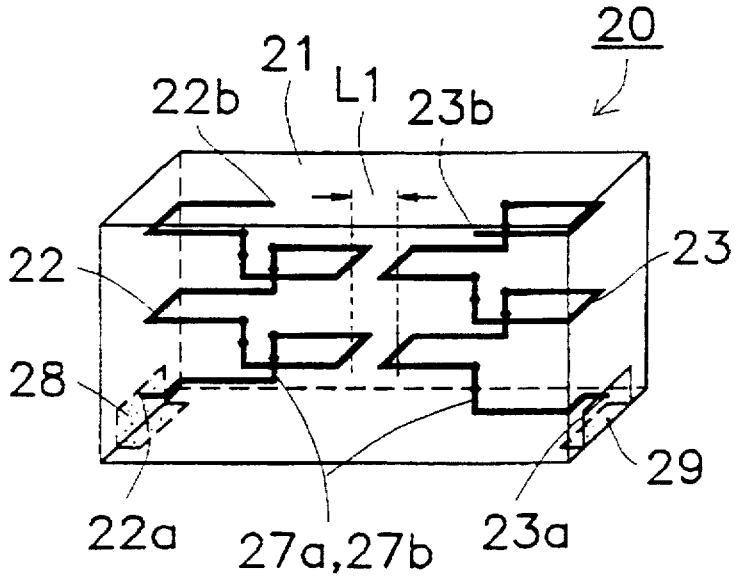
FIG. 3 is an isometric view illustrating a second embodiment of a chip antenna in accordance with the present invention.
Figure 4:
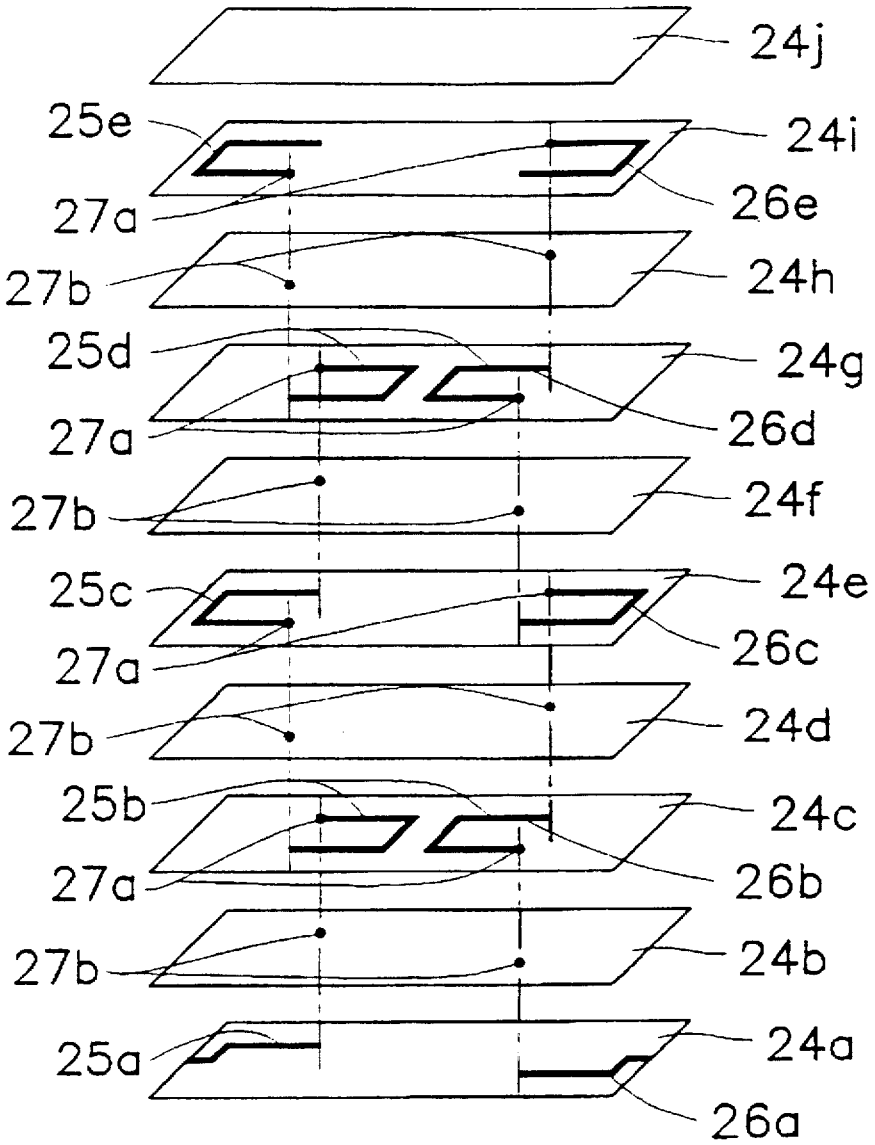
FIG. 4 is a decomposed isometric view of the chip antenna in FIG. 3.

FIG. 3 is an isometric view illustrating a second embodiment of a chip antenna in accordance with the present invention, and FIG. 4 is a decomposed isometric view of FIG. 3. The chip antenna 20 is provided with two conductors 22, 23 spirally arranged along the vertical direction in a rectangular parallelopiped substrate 21. The substrate 21 is formed by laminating rectangular dielectric sheets 24a through 24j each preferably comprising a dielectric material mainly containing titanium oxide, barium oxide and neodymium oxide. The dielectric sheets 24a, 24c, 24e, 24g and 24i are provided on their surfaces with angular conductive patterns 25a through 25e (25b through 25e being approximately U-shaped) and 26a through 26e (26b through 26e being approximately U-shaped), respectively, which are formed by printing, evaporation, adhesion, or plating, etc., and preferably comprise a silver-palladium (Ag-Pd) alloy. One end of each of conductive patterns 25b through 25e and 26b through 26e is provided with a via hole 27a.

Each of the conductive sheets 24b, 24d, 24f and 24h is provided with a via hole 27b at the position corresponding to the via hole 27a, in other words, corresponding to one end of the conductive patterns 25a and 26a and the other end of the conductive patterns 25b through 25d and 26b through 26d. After the dielectric sheets 24a through 24j are laminated with heat, the conductive patterns 25a through 25e and 26a through 26e connect with each other through via holes 27a and 27b to form the spiral conductors 22 and 23 each having a rectangular cross-section. The thickness of each of the dielectric sheets 24b through 24i is determined by a predetermined frequency of the antenna.

One end of each of the conductors 22 and 23 (the other ends of the conductive patterns 24a and 26a) is drawn out to the surface of the substrate 21 to form a respective feeding section 22a and 23a which connect with feeding terminals 28 and 29, respectively, on the surface of the substrate 21 for applying a voltage to the conductors 22 and 23. The other ends of the conductors 22 and 23 (the other ends of the conductive patterns 25e and 26e) form free ends 22b and 23b in the substrate 21.

In the second embodiment as set forth above, because a plurality of conductors are provided inside the substrate comprising a dielectric material, the line length of the conductor is shortened due to the wavelength shortening effect of the substrate, resulting in the achievement of miniaturization of the multi-resonance antenna or array antenna.

Figure 5:
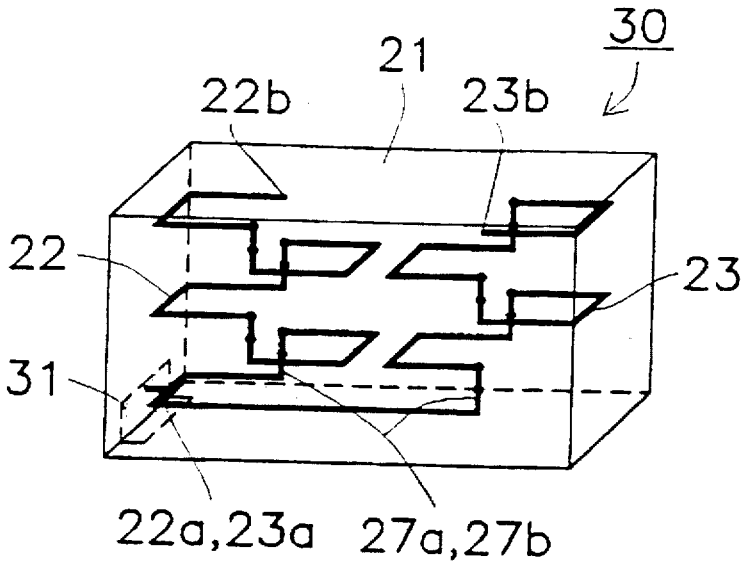
FIG. 5 is an isometric view illustrating a third embodiment of a chip antenna in accordance with the present invention.

FIG. 5 is an isometric view illustrating a third embodiment of a chip antenna in accordance with the present invention. The chip antenna 30 has only one feeding terminal 31 for supplying a voltage common to conductors 22 and 23, differing from the chip antenna 20 in the second embodiment having two feeding terminals.

Because only one feeding terminal is used in the third embodiment set forth above, a chip antenna having an array structure can be obtained by setting the space between the conductors to $\lambda/4$, for example, wherein $\lambda$ is the wavelength inside the substrate.

Figure 6:
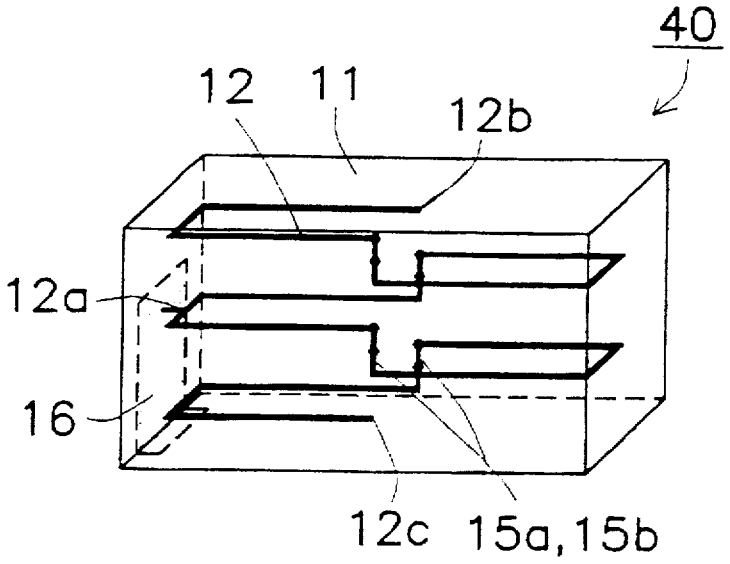
FIG. 6 is an isometric view illustrating a fourth embodiment of a chip antenna in accordance with the present invention.
Figure 7:
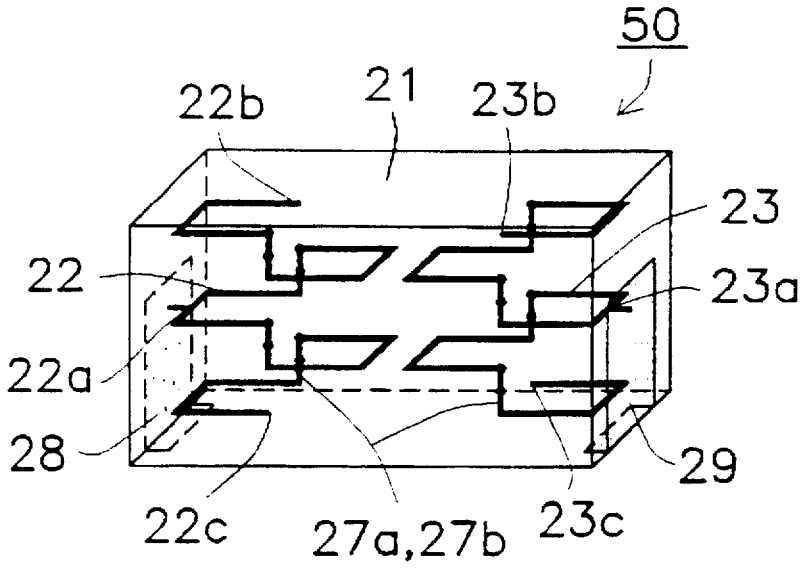
FIG. 7 is an isometric view illustrating a fifth embodiment of a chip antenna in accordance with the present invention.
Figure 8:
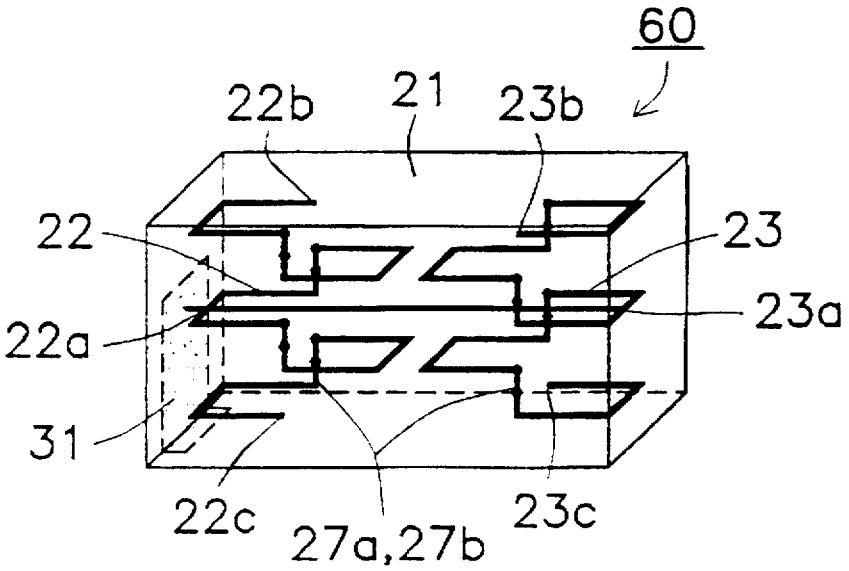
FIG. 8 is an isometric view illustrating a sixth embodiment of a chip antenna in accordance with the present invention.
Figure 9:
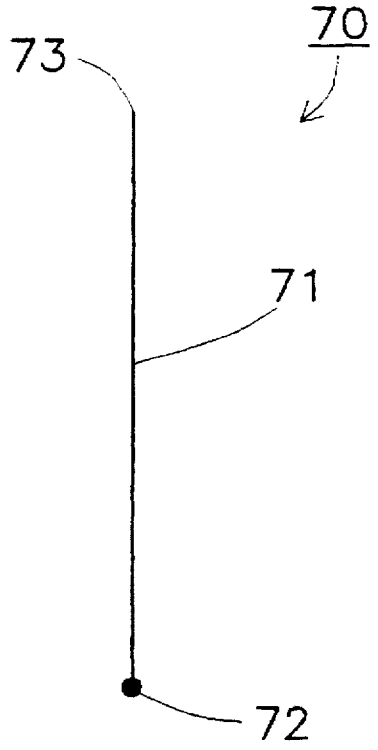
FIG. 9 PRIOR ART
FIG. 9 shows a prior art monopole antenna.

FIGS. 6, 7 and 8 are isometric views illustrating fourth, fifth and sixth embodiments of a chip antenna in accordance with the present invention. Chip antennas 40, 50, and 60 are provided with their respective feeding sections 12a, 22a and 23a, each connecting with any one of feeding terminals 16, 28, 29 and 31 for applying a voltage to the conductors 12, 22 and 23, at any portions other than the end section of the conductors 12, 22 and 23, unlike chip antennas in the first, second, and third embodiments. The end sections of the conductors 12, 22 and 23 form free ends 12b, 12c, 22b, 22c, 23b and 23c in the substrates 11 and 21.

In the fourth to sixth embodiments as set forth above, since each feeding section connecting with its respective feeding terminal is provided at a place other than the end section of the conductor, a chip antenna having a plurality of resonance frequencies can be obtained by providing the feeding section at desired positions. This antenna has a structure identical to a plurality of monopole antennas, each having a different resonance frequency, connected to each other. Accordingly, the multi-resonance antenna can be miniaturized.

Figure 11:
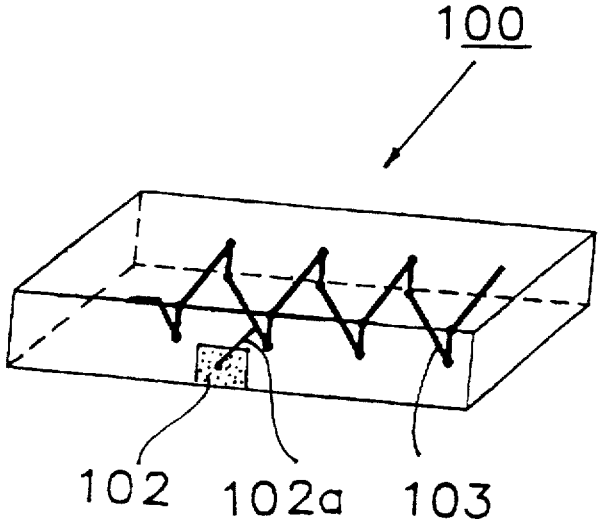
FIG. 11 is an isometric view illustrating a seventh embodiment of a chip antenna in accordance with the present invention.

FIG. 11 is an isometric view illustrating a seventh embodiment of a chip antenna in accordance with the present invention. Chip antenna 100 has a feeding terminal 103 for supplying a voltage to a conductor 102, the feeding section 102a for connecting the conductor 102 to the feeding terminal 103. The feeding section 102a can be located at any portion of the conductor 102.

The relative bandwidth and the conductor length or line length of the chip antennas 10 and 40 and of the prior art monopole antenna 70 may be compared to each other. The results are shown in Table 1. These chip antennas 10 and 40 and the monopole antenna 40 are designed for 1.9 GHz.

TABLE 1

| Antenna Type | Line Length (mm) | Relative Bandwidth (%) |
|---|---|---|
| Chip Antenna 10 | 1.0 | 3.1 |
| Chip Antenna 40 | 1.0 | 3.3 |
| Monopole Antenna 70 | 4.0 | 3.4 |

Figure 10:
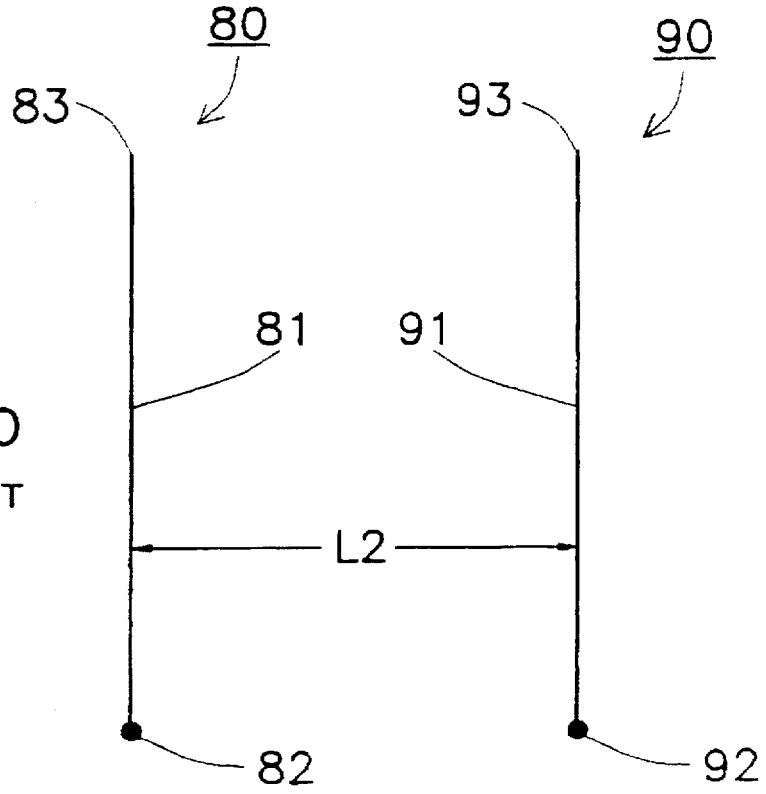
FIG. 10 PRIOR ART
FIG. 10 shows a multi-resonance antenna using prior art monopole antennas.

Next, chip antenna 20 is compared with a multi-resonance antenna comprising the monopole antennas 80 and 90 in terms of relative bandwidth, line length and the space between the conductors (L1 in FIG. 3 and L2 in FIG. 10). The results are summarized in Table 2. The conductor 22 of the chip antenna 20 and the monopole antenna 80 are designed for 1.9 GHz and the conductor 23 of the chip antenna 20 and the monopole antenna 90 are designed for 1.85 GHz.

TABLE 2

| Antenna Type | Line Length (mm) | Space between Conductors(mm) | Relative Band Width (%) |
|---|---|---|---|
| Chip Antenna 20 | | L1 = 5.3 | 5.9 |
| Conductor 22 | 1.0 | | |
| Conductor 23 | 1.1 | | |
| Multi-resonance Antenna | | L2 = 38 | 5.7 |
| Monopole Antenna 80 | 4.0 | | |
| Monopole Antenna 90 | 4.2 | | |

In Tables 1 and 2, the relative bandwidth is calculated by the following equation:

Relative bandwidth (%)=(Band width [GHz]/Center frequency [GHz])×100

In the embodiments shown in Tables 2 and 3, the line length is shortened to approximately one-fourth and the space between the conductors is shortened to approximately one-seventh while maintaining substantially the same relative band width as compared with the prior art monopole antennas. Thus, the chip antenna can be miniaturized.

The relative bandwidth is identical regardless of the position of the feeding section in the conductor.

Although the conductor(s) is provided inside the substrate in the embodiments set forth above, the conductor can be provided on at least one side of the surface of and/or inside the substrate or on a surface inside the substrate.

The conductor can also be meanderingly provided on at least one side of the surface of and/or inside the substrate or a surface inside the substrate.

The positions of the feeding and fixing terminals are not essential for the practice of the present invention.

The chip antenna in accordance with the present invention enables the line length and the space between the conductors to be shortened while maintaining the relative bandwidth identical to prior art monopole antennas, and thus enables substantial miniaturization.

Further, a compact multi-resonance antenna or array antenna can be produced by selecting the number of the conductors and feeding terminals.

Moreover, a chip antenna, in which a feeding section can be provided at an appropriate position, can be obtained.

Furthermore, although embodiments have been shown using substrates comprising dielectric materials, the invention can also use magnetic substrates in place of the dielectric substrates.

Although the cross-section of the spiral conductor in the embodiments shown is substantially rectangular, other cross-sections can be used, e.g., square, triangular, circular, semi-circular, etc. Also, the substrate need not be a rectangular parallelopiped but may be of some other shape such as a cube, polyhedron, prism, cone, etc.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A chip antenna comprising a substrate comprising at least one of a dielectric material and a magnetic material, at least one conductor formed inside the substrate, and at least one feeding-terminal provided on the surface of said substrate for applying a voltage to said conductor, the at least one conductor being a single continuous conductor arranged spirally and having two free ends, a part of said continuous conductor connecting with said feeding terminal such that said two free ends are located inside the substrate.

2. A chip antenna according to claim 1, wherein an end section of said conductor connects with said feeding terminal.

3. A chip antenna according to claim 1, wherein a part of said conductor other than an end section of said conductor connects with said feeding terminal.

4. A chip antenna according to claim 1, wherein the substrate comprises a plurality of laminated sheets, respective ones of said sheets having a respective portion of the conductor disposed on a surface thereof, at least one via hole on respective ones of said sheets interconnecting said portions to form said conductor when said sheets are laminated together.

5. A chip antenna according to claim 1, further comprising a plurality of said conductors.

6. A chip antenna according to claim 5, wherein an end section of each of said plurality of conductors is connected to a separate feeding terminal.

7. A chip antenna according to claim 5, wherein end sections of a plurality of said conductors are connected to a common feeding terminal.

8. A chip antenna according to claim 5, wherein each conductor has two end sections, and a portion of each conductor intermediate the two end sections is connected to a separate feeding terminal.

9. A chip antenna according to claim 5, wherein each conductor has two end sections, and a portion of each of a plurality of the conductors intermediate the two end sections is connected to a common feeding terminal.

10. A chip antenna according to claim 5, wherein a length of each conductor is less than a length of each element of an array antenna operating in air for the same frequency of operation for corresponding conductors and elements and substantially the same bandwidth and further wherein a spacing between the conductors is less than a spacing between elements of the array antenna.

11. A chip antenna according to claim 1, wherein the conductor is substantially rectangular in cross-section.

12. A chip antenna according to claim 1, wherein the substrate is one of a rectangular parallelopiped, cube and polyhedron.

13. A chip antenna according to claim 1, wherein a length of the conductor is less than a length of a monopole antenna operating in air for the same frequency of operation and substantially the same bandwidth.

14. A chip antenna according to claim 1, wherein the conductor comprises a silver-palladium alloy.

15. A chip antenna according to claim 1, wherein the substrate comprises one of titanium oxide, barium oxide and neodymium oxide.

16. A chip antenna according to claim 1, wherein the conductor is formed by one of printing, evaporation, adhesion and plating.

17. A chip antenna according to claim 1, wherein the substrate has first and second ends defining a surface of the substrate, the feeding terminal being provided on the surface of the substrate intermediate the ends.

18. A chip antenna according to claim 17, further comprising a feeding section of the conductor coupling the conductor to the feeding terminal.

19. A chip antenna according to claim 18, wherein the feeding section is intermediate the ends.

* * * * *